US009695589B2

(12) United States Patent
Dixon et al.

(10) Patent No.: US 9,695,589 B2
(45) Date of Patent: Jul. 4, 2017

(54) PRE FABRICATED WALL FORM AND SYSTEM

(71) Applicant: Defender Technologies, LLC, Franklin, TN (US)

(72) Inventors: Riji Lamar Dixon, Gulf Shores, AL (US); Michael W. Starkweather, Sandy, UT (US)

( * ) Notice: Subject to any disclaimer, the term of this patent is extended or adjusted under 35 U.S.C. 154(b) by 0 days.

(21) Appl. No.: 14/290,370

(22) Filed: May 29, 2014

(65) Prior Publication Data

US 2015/0068146 A1 Mar. 12, 2015

Related U.S. Application Data

(60) Provisional application No. 61/829,003, filed on May 30, 2013.

(51) Int. Cl.

| | |
|---|---|
| ***E04B 2/00*** | (2006.01) |
| ***E04B 2/10*** | (2006.01) |
| ***E04B 1/16*** | (2006.01) |
| ***E04B 1/343*** | (2006.01) |
| ***E04C 2/04*** | (2006.01) |
| ***E04C 5/06*** | (2006.01) |
| ***E04C 5/16*** | (2006.01) |
| *E04B 2/02* | (2006.01) |

(52) U.S. Cl.

CPC ..... *E04B 2/10* (2013.01); *E04B 1/167* (2013.01); *E04B 1/34321* (2013.01); *E04C 2/044* (2013.01); *E04C 2/46* (2013.01); *E04C 5/064* (2013.01); *E04C 5/168* (2013.01); *E04B 2001/34389* (2013.01); *E04B 2002/0278* (2013.01); *E04B 2002/0284* (2013.01)

(58) Field of Classification Search

USPC ..... 52/431, 561, 568

See application file for complete search history.

(56) References Cited

U.S. PATENT DOCUMENTS

| | | | | |
|---|---|---|---|---|
| 4,226,061 | A * | 10/1980 | Day, Jr. | 52/125.2 |
| 2005/0235590 | A1* | 10/2005 | Pace | 52/263 |
| 2008/0104911 | A1* | 5/2008 | Jarvie et al. | 52/309.1 |
| 2011/0131911 | A1* | 6/2011 | McDonagh | 52/426 |
| 2011/0314760 | A1* | 12/2011 | Degen et al. | 52/426 |
| 2012/0137613 | A1* | 6/2012 | Schurmann | 52/426 |
| 2012/0233950 | A1* | 9/2012 | Carr et al. | 52/426 |

* cited by examiner

*Primary Examiner* — Brian Glessner
*Assistant Examiner* — Gisele Ford
(74) *Attorney, Agent, or Firm* — Michael W. Starkweather

(57) ABSTRACT

A concrete wall pre fabrication for the easy assembly of walls for residential and commercial buildings. More specifically, there is an apparatus and method for enabling the outer form of a concrete wall to be more precisely assembled off site and then transported to the work site and assembled the wall in the proper place with appropriate rebar before filling the forms with cement or concrete material as disclosed in the specification and drawings of the invention and the related claims. Additionally, there is a need for a form spacer that efficiently attaches between the form walls with a more precise use of glue and stronger attachment to the form walls.

7 Claims, 8 Drawing Sheets

PRE FABRICATED WALL FORM AND SYSTEM

PRIORITY REFERENCE TO RELATED APPLICATION

This application claims the priority benefit under 35 U.S.C. §119(e) from provisional Application No. 61/829,003, filed May 30, 2013, which is hereby incorporated herein by reference.

BACKGROUND OF THE INVENTION

1. Field of the Invention

The present disclosure is directed to a pre fabricated concrete wall form apparatus and system for the easy assembly of walls for residential and commercial buildings. More specifically, there is an apparatus and method for enabling the outer form of a concrete wall to be assembled off site and then transported to the work site and assembled with rebar before filling the forms with cement or concrete material and leaving the complete assembled structure in place with no removal of concrete forms as disclosed in the specification and drawings of the invention and the related claims.

2. Description of the Related Art

It is well known to in the art of building construction, and in particular the creation of concrete based walls how to create concrete forms prior to pouring the concrete therein. It is also well known in the art to provide two parallel spaced wall forms to hold the concrete in the desired shape until drying sufficiently to allow the two wall forms to be removed to leave the concrete wall exposed to the environment. Recently, there have even been prior art that use forms that are intended to stay in place after the concrete has hardened. The following patents are provided as examples of such known art, and are herein incorporated by reference for their supporting teachings to the disclosed invention, whereby:

US Patent Applications 2012/0233950 by Jerry R. Carr, filed Mar. 17, 2011, is a concrete wall system includes first and second opposing wall panels and a plurality of spacers disposed between the first and second Wall panels. A plurality of reinforcing bars is placed between the first and second Wall panels and supported by the spacers, and a concrete core is disposed between the first and second Wall panels such that the spacers and the reinforcing bars are embedded in the concrete core. Each one of the spacers has a cup-like body defining a closed first end and an open second end with a flange formed on the second end. The spacer bodies are tapered so that the spacers are stackable.

U.S. Pat. No. 6,622,452 to Alvero, issued Sep. 23, 2003, is an insulated concrete wall construction method and apparatus.

U.S. Pat. No. 3,638,382 to Merrill, filed 1969, is a Form for a concrete wall structure.

U.S. Pat. No. 7,549,261, to Parish, prosecuted by Michael W. Starkweather, and issues on Jun. 23, 2009, is a device, system, and method of holding rebar in a substantially fixed position in a surface.

U.S. Pat. No. 6,536,172 to Amend, issued on Data of Mar. 25, 2003, is an insulating construction form and manner of employment for same.

U.S. Pat. No. 6,401,413, to Niemann, issued Jun. 11, 2002, is a concrete form wall building system.

U.S. Pat. No. 5,570,552, to Gibbar, Jr., issued Dec. 22, 1992, teaches of a prefabricated polymer building wall panels.

U.S. Pat. No. 5,172,532, to Nehring, issued Nov. 5, 1996, teaches of a universal wall forming system.

U.S. Pat. No. 6,167,671, to Wilson, issued Jan. 2, 2001, teaches of a prefabricated concrete wall form system.

U.S. Pat. No. 6,250,033, to Zelinsky, issued Jun. 26, 2001, teaches of a vertical and horizontal forming members for poured concrete walls.

U.S. Pat. No. 6,321,496, to Martin, Jr., issued Nov. 27, 2001, teaches of insulated form assembly for a poured concrete wall.

US Patent 2012/0047816, to Zhong, published Mar. 1, 2012, teaches of prefabricated wall panels.

None of these prior art patents or applications teaches the disclosed invention either singly or in combination. What is needed in the art of concrete wall formation is an apparatus and system for pre fabricated concrete wall form apparatus and system for the easy assembly of walls for residential and commercial buildings. More specifically, there is a need for an apparatus and method for enabling the outer form of a concrete wall to be more precisely assembled off site and then transported to the work site and assembled with rebar before filling the forms with cement or concrete material and leaving the form attached to the concrete wall as disclosed in the specification and drawings of the invention and the related claims. Additionally, there is a need for a form spacer that efficiently attaches between the form walls with a more precise use of glue and stronger attachment to the form walls.

SUMMARY OF THE INVENTION

The present invention has been developed in response to the present state of the art, and in particular, in response to the problems and needs in the art that have not yet been fully solved by currently available pre fabricated concrete wall apparatus and systems. Accordingly, the present invention has been developed to provide a concrete wall pre fabrication for the easy assembly of walls for residential and commercial buildings. More specifically, there is an apparatus and method for enabling the outer form of a concrete wall to be more precisely assembled off site and then transported to the work site and assembled the wall in the proper place with appropriate rebar before filling the forms with cement or concrete material as disclosed in the specification and drawings of the invention and the related claims. Additionally, there is a need for a form spacer that efficiently attaches between the form walls with a more precise use of glue and stronger attachment to the form walls.

In one embodiment of the illustrated invention there is a pre fabricated concrete wall form, comprising: a) a first and second wall having a major surface facing each other; b) at least one wall spacer positioned between and coupling together the first and second wall, wherein the wall spacer includes: i) a top and bottom spacer wall, each having at least one hole formed in each; ii) a first and second side spacer wall, coupled to the respective first and second wall; iii) a first and second oppositely facing opening defined by the top, bottom, first and second side spacer walls; and) iv) a central plate coupled within the top, bottom, first and second side spacer walls, wherein the central plate has a central plate hole; c) at least one vertical and horizontal rebar, where the vertical rebar extends between the two walls and through the one hole formed in each of the top and bottom spacer wall, and the horizontal rebar extending between the two walls and through the first and second oppositely facing opening and through the central plate hole; and d) a layer of concrete positioned between the first and second wall, and substantially filling the wall spacer through the first and second opening.

One embodiment of the illustrated invention may include a first and a second side spacer walls that are coupled to the respective first and second wall is coupled therebetween by glue.

Another embodiment may be where the first and second side spacer walls have at least one hole placed therein for holding a portion of the glue therethrough and forming a mushroom head of glue over the holes.

Further, an embodiment may be where the first and second side spacer walls have at least one glue spacer that perpendicularly extends from the first and second side spacer walls sufficiently to form a cavity between the first and second side spacer walls and the respective first and second walls.

In another variation of the invention may be where the glue spacer is a rounded nub or a pointed pyramid that may imbed the point a certain distance into the respective first and second wall.

There is also described a method of assembling a pre fabricated concrete wall, comprising: a) placing a first wall laid out in a horizontal position; b) placing glue on the first wall in at least one location; c) placing a wall spacers over the glue; d) prepare a second wall by laying it horizontal, and applying glue to a respective matching location to that placed on the first wall; e) placing the second wall on the opposite side of the wall spacers so that the glue abuts to the wall spacer to form a wall section; f) drying the glue on the wall section; g) transporting the wall section to a building work site; h) providing a building with a foundation of concrete that was pored and formed with vertical rebar; i) lifting up and sliding the wall section over the vertical rebars to fit through holes located in the wall spacers; j) inserting horizontal rebars through second holes in the wall spacers; k) using a connector tab to couple adjoining wall sections; and l) poring cement between the first and second wall.

Reference throughout this specification to features, advantages, or similar language does not imply that all of the features advantages that may be realized with the present invention should be or are in any single embodiment or the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

BRIEF DESCRIPTION OF THE DRAWINGS

In order for the advantages of the invention to be readily understood, a more particular description of the invention briefly described above will be rendered by reference to specific embodiments that are illustrated in the appended drawings. It is to be understood that these drawings depict only typical embodiments of the invention and are not therefore to be considered to be limiting of its scope, the invention will be described and explained with additional specificity and detail through the use of the accompanying drawings.

DETAILED DESCRIPTION OF THE ILLUSTRATED EMBODIMENTS

For the purposes of promoting an understanding of the principles of the invention, reference will now be made to the exemplary embodiment. Wherein, each statement of an embodiment is to be considered independent or any other embodiment, despite any use of similar or identical language.

Reference throughout this specification to "one embodiment," "an embodiment," or similar language that means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed. Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Figure 1:
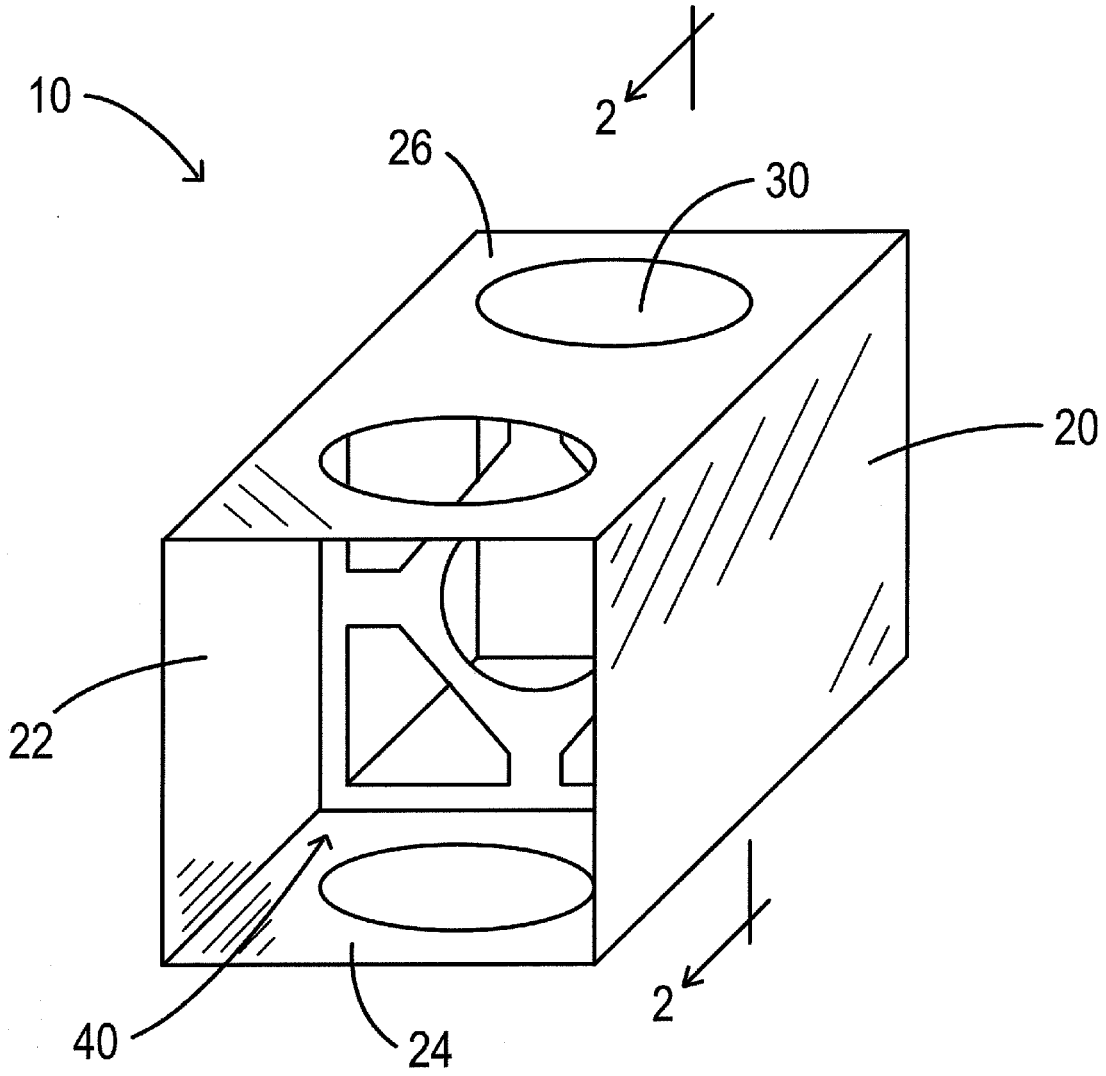
FIG. 1, there is one embodiment of an isometric illustration of a wall spacer used in the disclosed invention.
Figure 2:
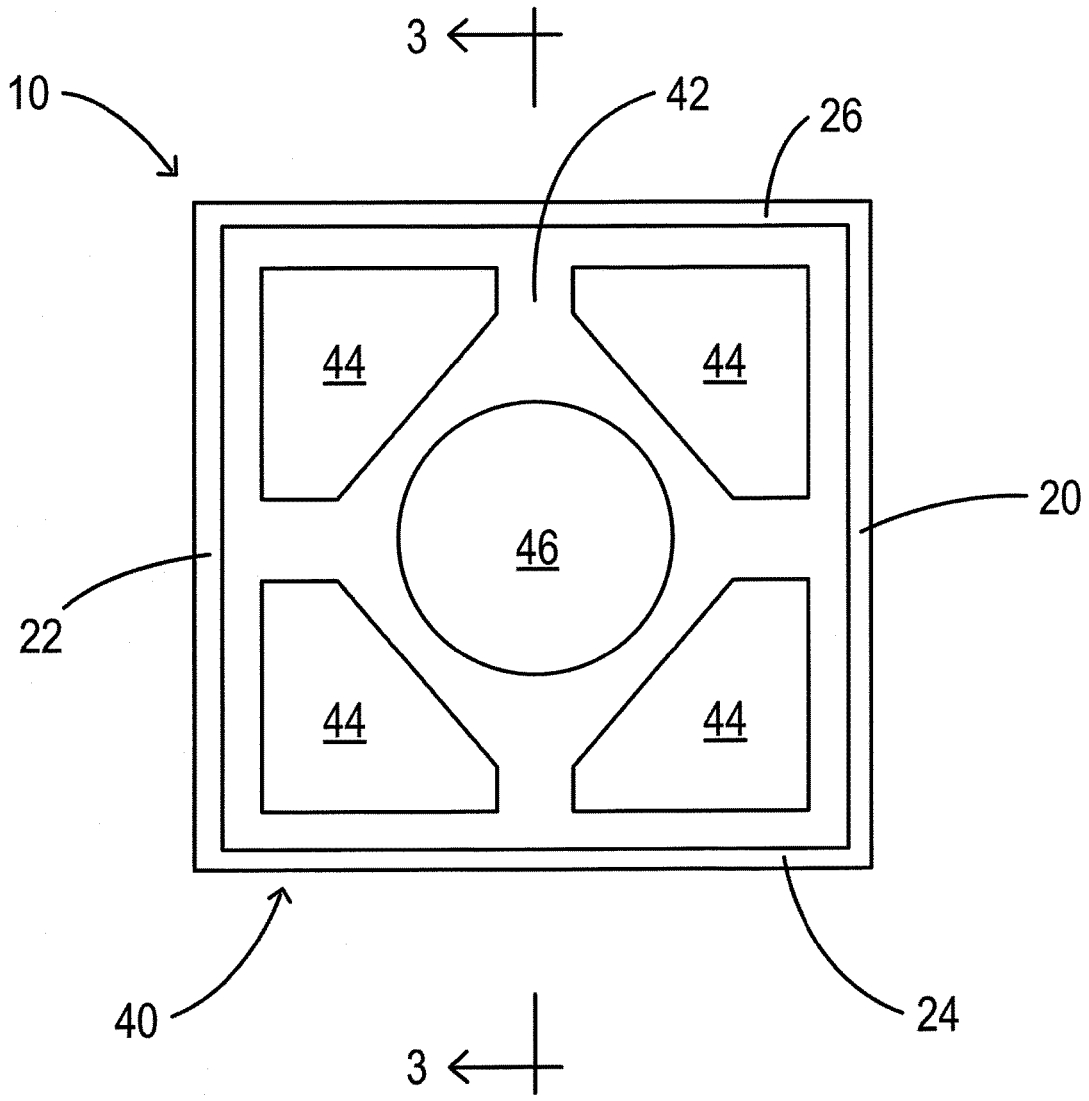
FIG. 2, there is one embodiment showing an open end view of FIG. 1.
Figure 3:
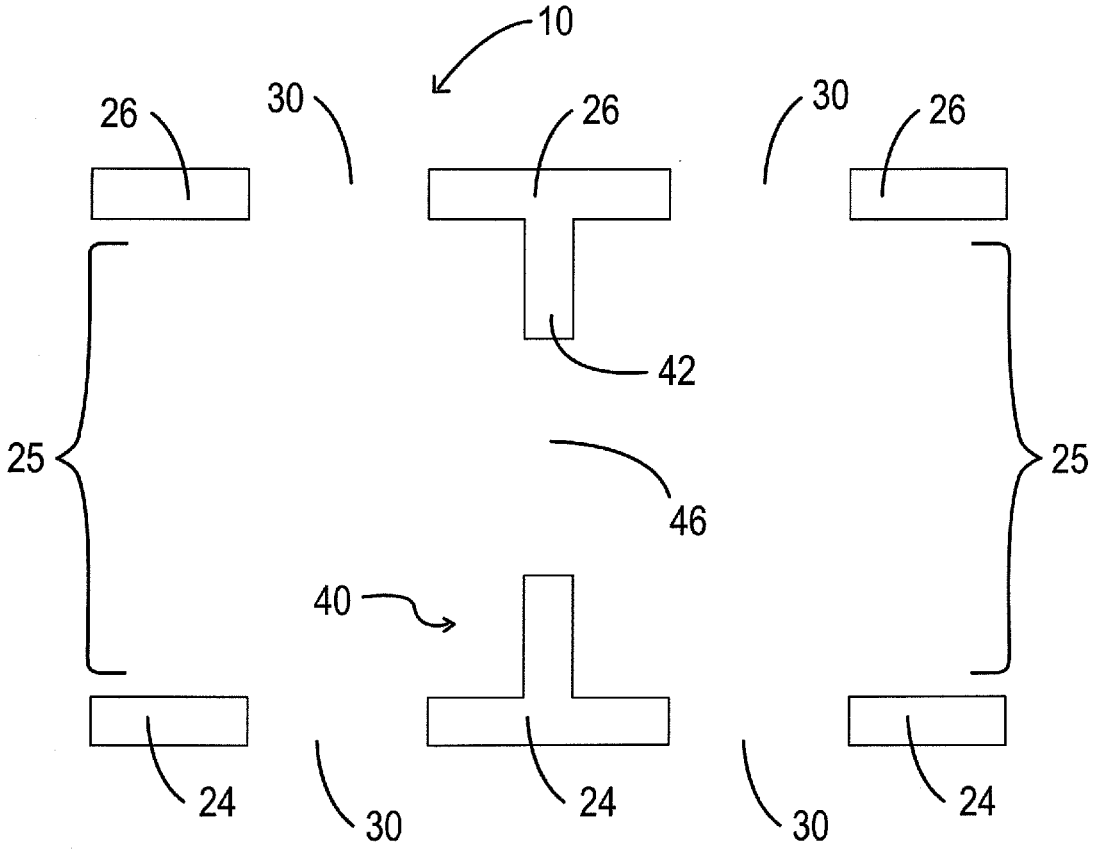
FIG. 3 illustrates a cross sectional side view of FIG. 1.

In reference to FIGS. 1, 2, and 3, there is an isometric illustration of a key portion of one embodiment of the present invention. There is shown one embodiment of a wall spacer 10 that has four solid walls 20, 22, 24 and 26 and two end openings 25 positioned opposite to each other as illustrated. Additionally, there is an internal central plate 40 coupled to the four solid walls in perpendicular arrangement as illustrated. There are also several holes 30 located on the top and bottom walls 20, 24, which are equally spaced on either side of the central plate 40 as illustrated. Moreover, central plate 40 has connecting portions 42 located thereon, which separates any holes 44, 46 located in the central plate 40 as illustrated.

Figure 4:
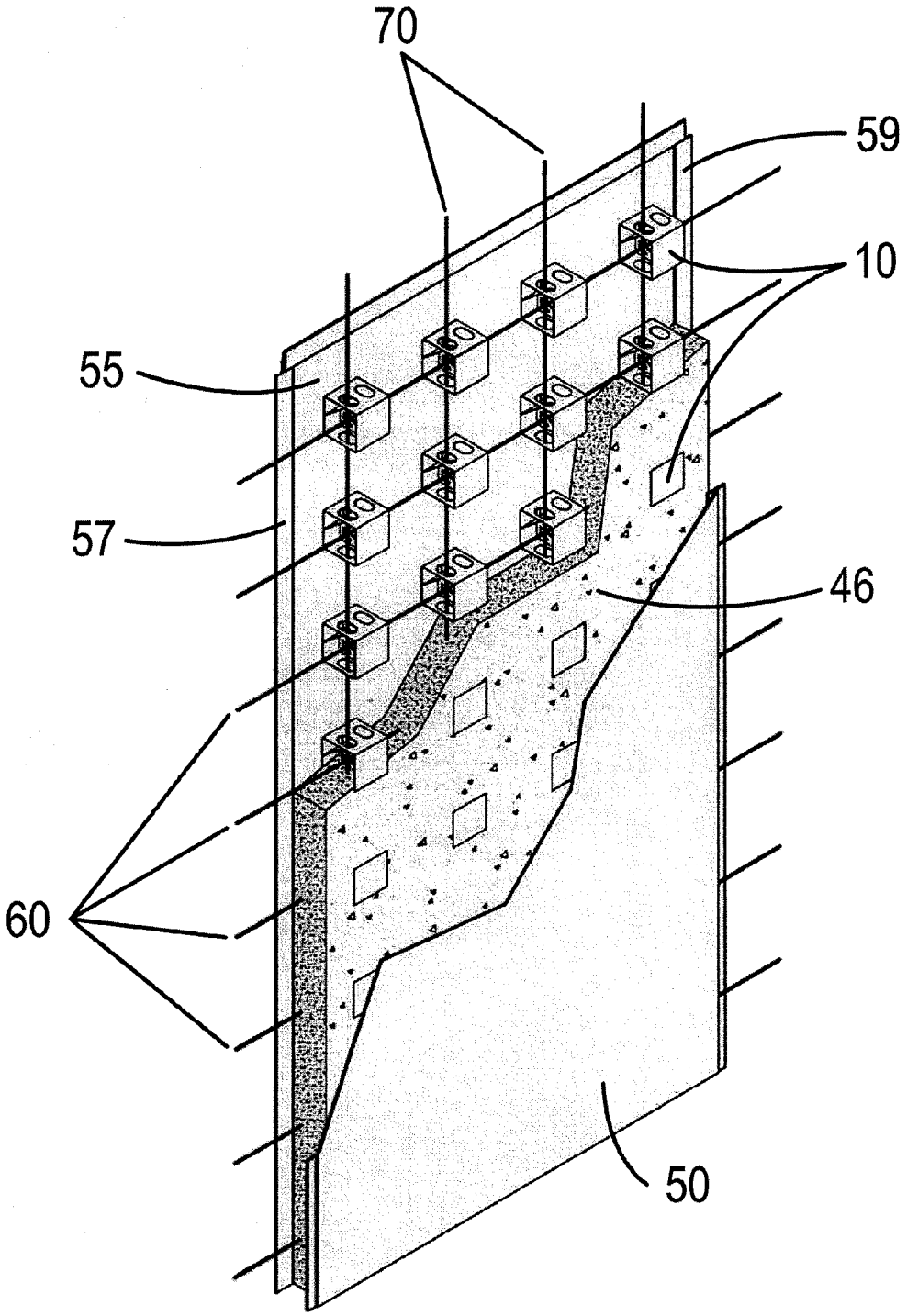
FIG. 4, there is a sectional isometric view of one embodiment of FIG. 1 imbedded in a wall section after concrete has been added.

Referring to FIG. 4, there is an isometric sectional embodiment of the fully assembled invention shown in a vertical position after concrete has been poured therein, and showing the placement of the wall spacers 10 illustrated in FIGS. 1, 2 and 3. Uniquely, the wall spacers 10 are fastened between each wall 50 and 55 to maintain the same distance therebetween during the transportation, erection and subsequent filling with concrete of the wall section 120. Specifically, there is illustrated one embodiment of the spaced apart nature of the wall spacers 10, and the potential placement of the rebar 60 and 70 extending through wall spacers 10 as illustrated. It is noted that the wall spacers 10 serve at least two purposes, one is to maintain a uniform space between the walls 50 and 55, and two, is to hold the rebar 60 and 70 in place to allow for the concrete 46 to be poured between the walls 50 and 55 when the wall section 120 is erected in normal wall building fashion. Further, there is illustrated the placement of the concrete 46 around and within the wall spacers 10. It is noted that the vertical rebar are often anchored into the concrete foundation of a building before the wall section 120 is inserted over the rebar 70. Each wall section 120 also has a wall connection tab 57, 59 coupled to the sides of the wall 50 and 55. The wall connection tabs 57, 59 may be located around only one side, two, three or all four sides of each wall 50, 55 as needed.

Figure 5:
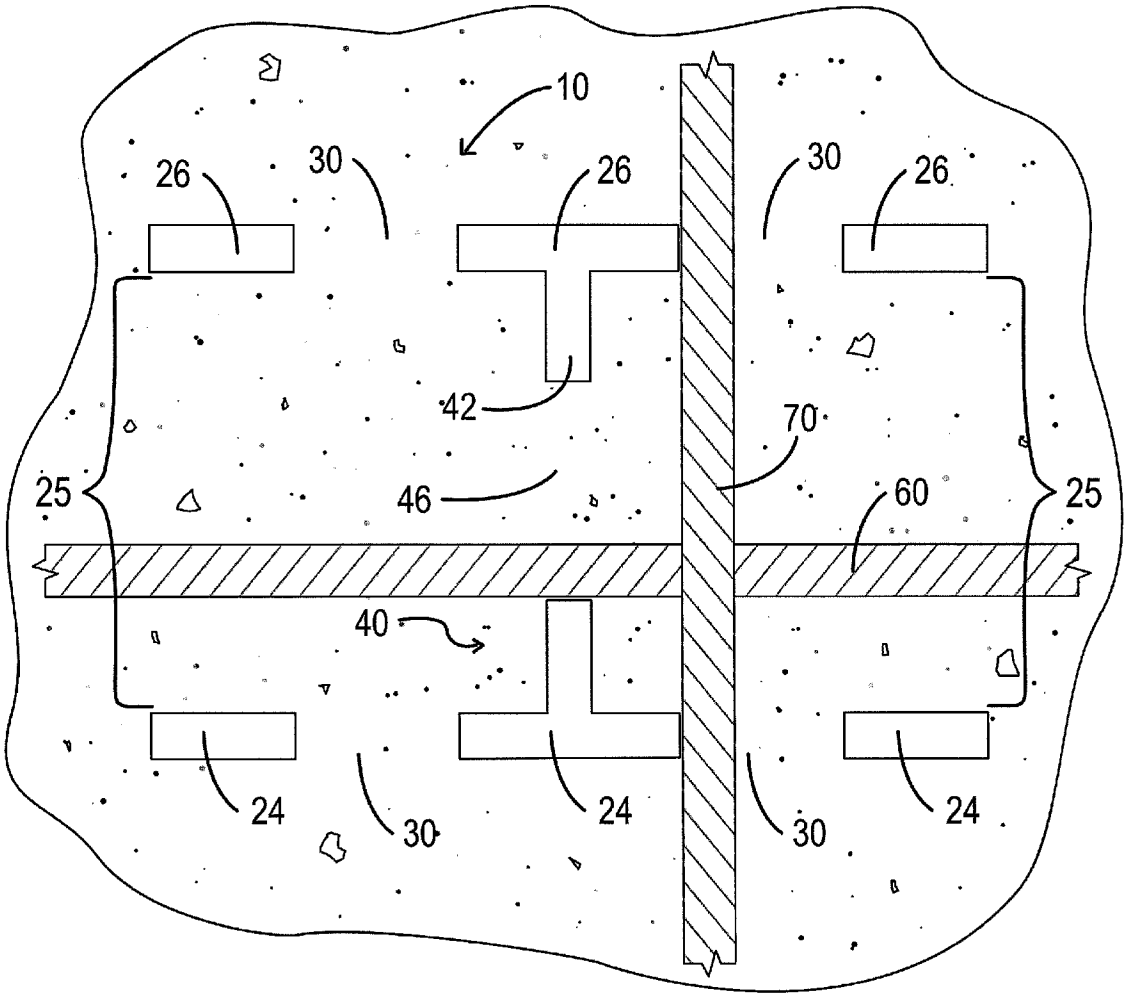
FIG. 5 illustrates a sectional side view of FIG. 3 or a portion of FIG. 4 showing the rebar positioning therethrough.

FIG. 5 illustrate a cross sectional view of one portion of FIG. 4 with rebar and concrete placed therein. Uniquely, there is illustrated a cross sectional view of a single wall spacer 10 with the two rebar 60, 70 extending through the respective holes 46 and 30. Additionally, there is illustrated that the placement of the holes and open ends 25 of the wall spacer 10 allows for a complete filling of the wall spacers 10 with concrete. Whereby, prior art designs of a cone do not have the open ends facing as such, which will prevent a complete filling of the wall spacer 10, which creates voids or bubbles therein that weak points in the wall structure.

Figure 6:
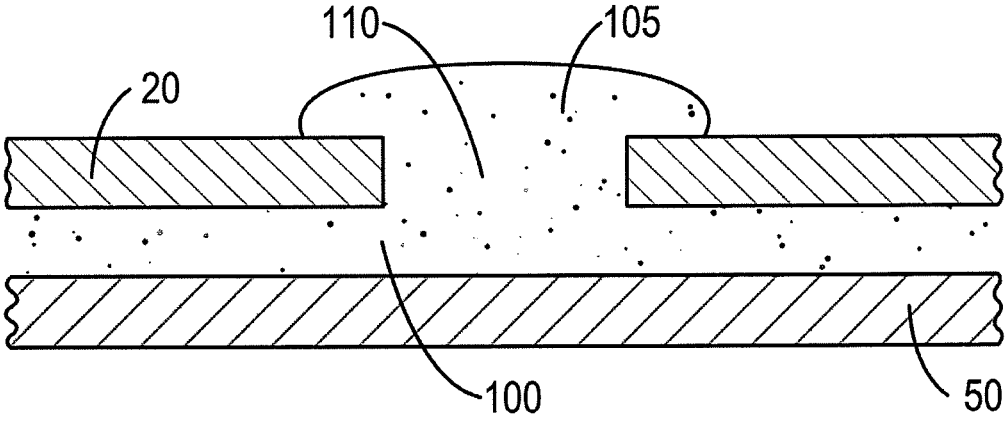
FIG. 6 illustrates one embodiment of a sectional side view of FIG. 3 with the added feature of placing at least one hole therein for added glue stabilization.
Figure 7:
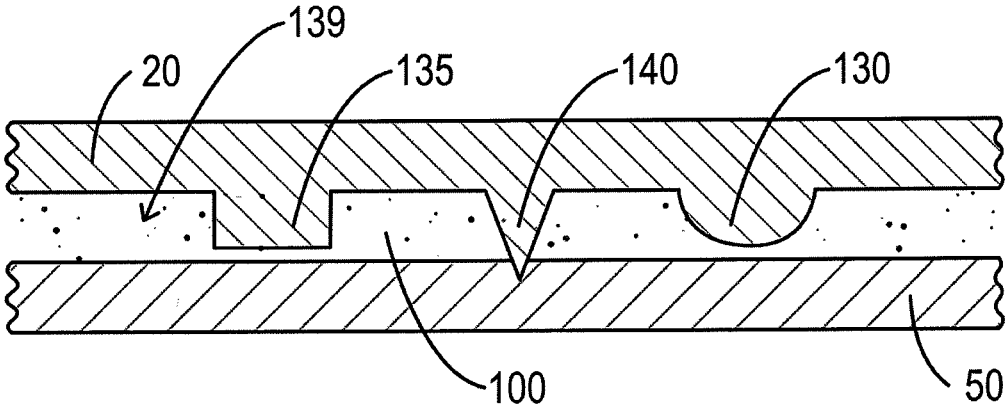
FIG. 7 illustrates one embodiment of a sectional side view of FIG. 3 with the added feature of placing at least one glue spacer thereon for creating a standardized glue cavity.

Referring to FIGS. 6 and 7, there is illustrated a sectional side view of the wall spacer 10 as it may be attached to the wall section 50. Specifically, fastening of the wall spacers 10 to the walls 50, 55 may be, in one embodiment, accomplished using any known type of suitable glue 100, or any other known fastening means, like welding, screws, etc. Uniquely, there is illustrated several variations of embodiments of the invention.

In FIG. 6 there is illustrated one embodiment showing the concept of placing a plurality of holes 110 in the sides 20, 22 of the wall spacer 10, which abut to the two building walls 50 and 55. In this fashion, when the wall spacer 10 sides 20, 22 are glued 100 to the respective walls 50, 55, the glue 100 will seep or be forced out of the holes 110 and may extend in a mushroom head shape 105, which will further hold the wall spacers 10 in place during the life of the illustrated invention 120.

In FIG. 7 there is further illustrated an additional embodiment showing three variations of glue spacers 130, 135, 140. Specifically, each of the glue spacers 130, 135, 140 are generally perpendicularly extending from the wall spacer sides 20, 22. In particular, in one embodiment, the glue spacers are shown to be a simple rectangle shape 135, a rounded nub shape 140, or a triangle shape 130. It is noted that the triangle-shaped glue spacer 130 is illustrated as potentially able to puncture into wall 50 a short distance to add to the further stability of the wall spacer 10 when it is placed over the glue 100. It is contemplated to have a plurality of at least one of the glue spacer variations 130, 135, or 140 placed all over the complete surface of the respective wall spacer sides 20, 22, which may be in a waffle pattern. An advantage of having the glue spacers is to create a uniform cavity 139 between the wall spacer sides 20, 22 and the respective building walls 50, 55, and to create additional surface area for the glue 100 to attach thereto.

Figure 8:
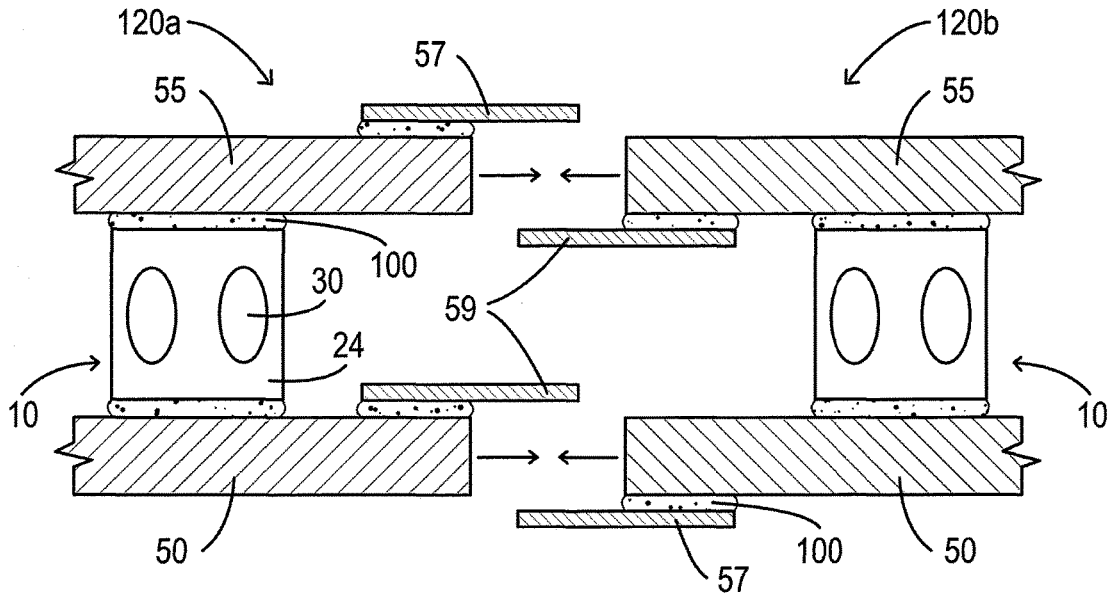
FIG. 8 illustrates a sectional side view of another embodiment of the invention that incorporates a first tab used to attach two adjacent wall sections.
Figure 9:
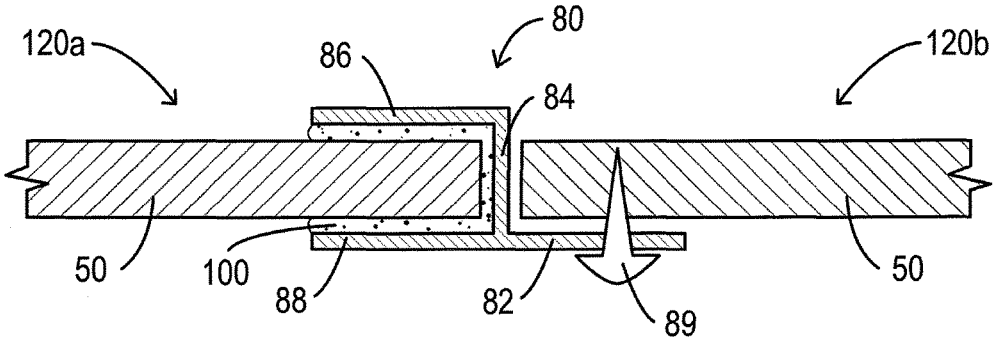
FIG. 9 illustrates a sectional side view of another embodiment of the invention that incorporates a second tab used to attach two adjacent wall sections.
Figure 10:
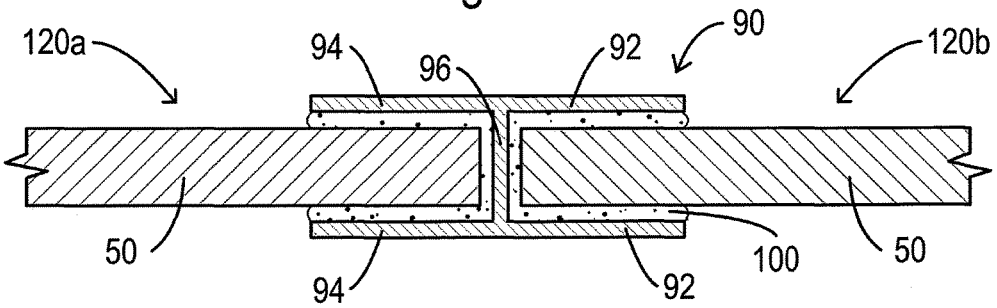
FIG. 10 illustrates a sectional side view of another embodiment of the invention that incorporates a third tab used to attach two adjacent wall sections.

Referring to FIGS. 8, 9 and 10 there is illustrated variations to wall sections 120 attachment tabs 57, 59, 80, 90. Specifically, in FIG. 8, there is illustrated two identical wall sections 120*a*, 120*b* that need to be attached to each other. In one potential illustrated embodiment, there are two wall tabs 57, 59 that are glued 100 to the respective walls 50, 55 as illustrated. Specifically, in wall section 120*a*, inner tab 59 is glued to the inside of wall 50, and outer tab 57 is glued to the outer sides of wall 55. However, on wall section 120*b*, wall 55 has inner tab 59, and wall 50 has outer tab 57 glued thereon. In this opposite arrangement, a skilled artisan can see that there is a match fit between the two wall sections 120*a*, 120*b*. After the wall sections 120*a*, 120*b* are brought together, the respective wall tabs 57, 59 may be fastened to the opposite wall section 120*a*, 120*b* via any known fastening system, such as nails, screws, glue, etc.

FIG. 9 illustrates only one side of the mirror arrangement for wall sections 120*a*, 120*b*. There is shown a slight variation to the tab design of FIG. 8, where tab 80 has a single extension 82, and a u-shaped section 84, 86, 88 that may be glued 100 to one end of the wall section 120*a*, and fastened by a screw 89 to the other wall section 120*b* as illustrated.

FIG. 10 illustrated another embodiment of a wall tab 90, where there are extensions 92, 94 that are each coupled to a connector piece 96, and the tab 90 may be attached, via glue 100, to both wall sections 120*a*, 120*b*.

One skilled in the art will realize that any of the tabs illustrated herein will run the entire length of a wall edge as illustrated best in FIG. 4. Also, it is understood that any of the tabs 57, 59, 80, 90 may be attached to the respective wall sections using any known attachment means, like glue, nails, screws or any combination thereof.

Figure 11:
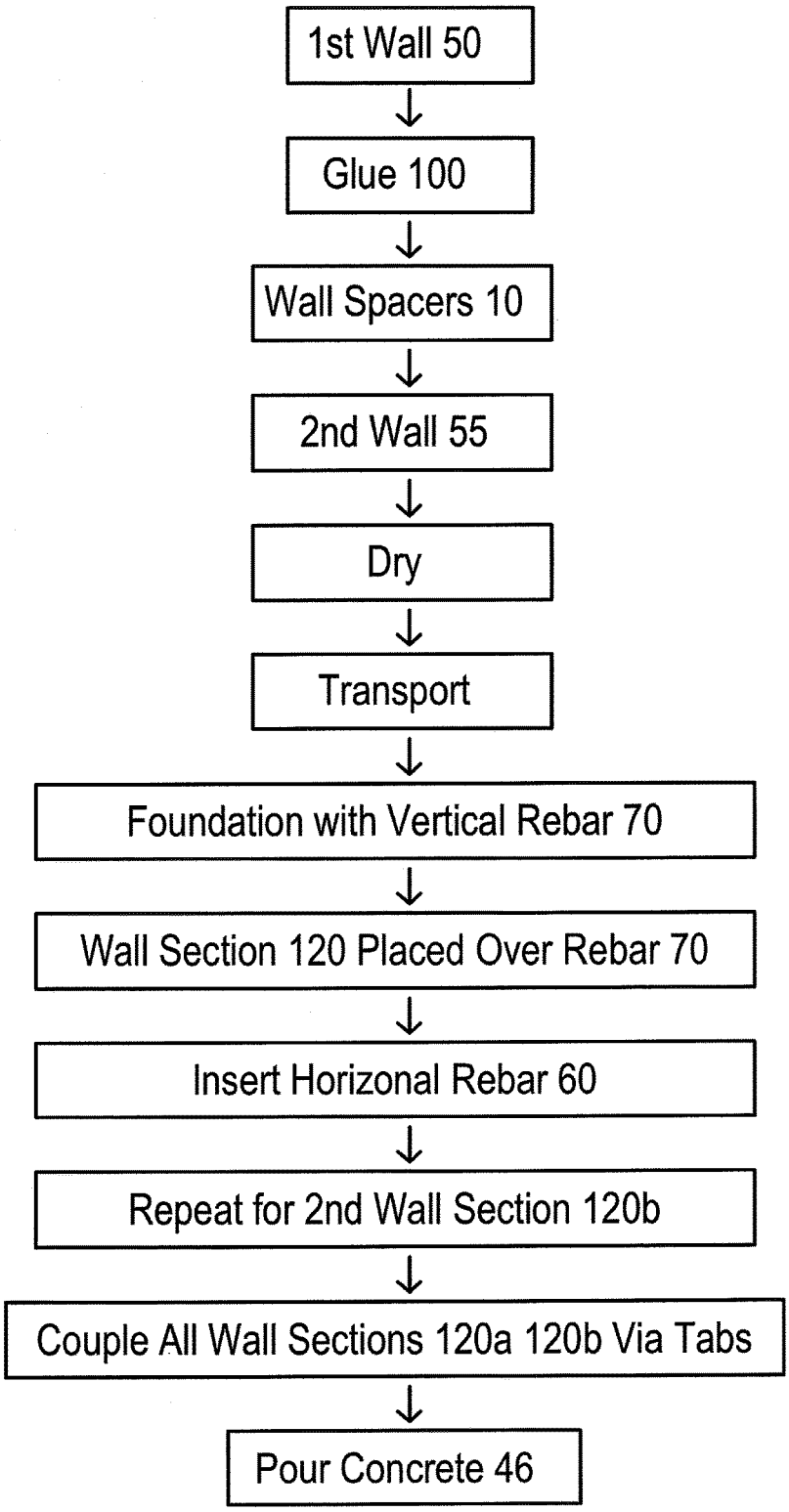
FIG. 11 illustrates a flow chart of the assembly of the entire wall section process.

Referring to FIG. 11, there is illustrated a flow chart of the assembly of the entire wall section 120 process. To start, a wall 50 is laid out with its tabs 57, 59 in a horizontal position. Thereby, glue 100 is placed on the wall 50 in the locations where the wall spacers 10 will be placed. Next, the wall spacers are placed over the glue 100 and may be allowed to dry at this time or may automatically proceed to the next step. The next step may be to prepare the second wall 55 with the laying it horizontal, and applying glue 100 to the respective locations. Whereby the second wall 55 is placed on the opposite side of the wall spacers 10. The assembled wall section 120 is then allowed to dry the glue 100. The wall sections 120 are then ready to be transported to a building work site. Next, the building will have a foundation of concrete pored and formed with vertical rebar 70 as is standard in the industry. Now, individual wall sections 120 are lifted up and slid over the vertical rebars 70 to fit through holes 30 located in the wall spacers as illustrated in FIGS. 4 and 5. Thereby, horizontal rebars 60 are inserted through holes 46 in the central plate 40 of the wall spacers 10. At this point, other items, like electrical wires or plumbing pipes may be placed through the wall section 120, and extend through holes 44 located in the central plate 40. Next, the same process is repeated for a second wall section 120*b*, and plumbing and wiring placement may take place at this time also. Whereby, the tabs 57, 59 are coupled (via screws, glue, nails etc.) to adjoining wall sections 120*b*. Once a sufficient section of walls are connected, cement is then pored therein and dried to add strength and support to the resulting wall as is customary in the industry.

It is noted that the illustrated invention is much better than typical prior art. It is many times stronger than typical wood-frame construction, for about the same cost, and much cheaper and more flexible architecturally than pre-cast concrete, and poured-form concrete whose forms have to be removed and the face finished before it is architecturally acceptable as an exposed face.

Further it is noted that roof trusses can be securely fastened to the wall sections 120 via various steel or other acceptable attachment devices that are attached to the rebar that is sunk into wet concrete in order to create a total structure that is cost effective and exponentially stronger than wood frame technology. While there are a variety of roof structures that may be employed, all must have a connecting system that is sunk into the wet concrete during the last stage of pouring and filling the wall sections 120. The ability to sink attachment devices into the wall sections 120 provides a continuous, uninterrupted, extremely strong method to essentially connect a roof directly to the footer via the reinforced concrete and re-bar. The main reason that a roof fails in strong winds, and particularly the torsional effects of a tornado, are because it becomes detached from the wall structure. No economical design has been proffered that will allow for this kind of strength.

Moreover, it is noted that building structures utilizing the illustrated invention are engineered to withstand winds as high as 200 mph, fire, water, earthquakes up to 7.0 on Richter scale, termites, carpenter ants, mold, mildew, and mudslides, and at a price comparable to the structurally inferior, yet ubiquitous, wood frame. Most importantly, this presently illustrated invention provides the needed protection from hurricanes and tornadoes and reduces property damage caused by natural elements, which will lower property insurance costs.

The nature of the fiber reinforced concrete being used as an in situ form that remains in place cannot be overstated. No other comparably priced structure can offer the fire and water resistance, strength, and resistance to attack by all natural occurrences with a finished-face like the illustrated embodiments.

It is noted that the vertically extended rebars 70 from the top of the wall section 120, or other extensions that may be added to the concrete before it hardens, will serve as a strong securing mechanism for the placement and attachment of a roof section. Thus, increasing the wall and roof attachment strength. For example, the rebar 70 may be at least bent in 90-degree angle over the roof supports or through the roof supports. It is also possible to bend the rebar 70 in any imaginable fashion and attaching such to the roof frame and structure.

It is noted that another common reason that a home is destroyed in a tornado or hurricane is because it becomes warped or twisted, thus enabling the wind to sever the connection of the wall with the roof. The current embodiments keep its shape when attacked by high winds, thus allowing the roof attachments and roof structure to operate as designed.

The present invention as illustrated has been tested to withstand light ballistics from 9 mm, .45 cal, and M-16 rounds fired at 25 meters. None of these rounds fired multiple times was able to penetrate more than a few millimeters into the surface and were not able to penetrate the wall section 120. Thus the illustrated embodiments provide protection from not only high winds, but from objects being hurled at it from the effects of a tornado.

The illustrated embodiment parts are common in design and shape in all aspects, excluding variation that includes differences in the width dimension, which typically comes in widths of 50 mm, 100 mm, 150 mm, and 200 mm (approximately 3-inch, 4-inch, 5-inch, and 6-inch widths). The two main dimensions are concerning the opposite faces of the walls 50, 55 to be used to affix with adhesive 100 the fiber cement sheet that makes up the permanent formwork panel. These always remain at (100 mm×100 mm), the two remaining faces of this spacer 10 have to walls, and there is a central stiffening wall with apertures 25 to allow flow of concrete therethrough, and easy placements of steel bars 60, 70 therethrough appropriate holes 46, 30.

It is noted that the typical concrete specifications are generally contractor grade 4000 psi, but other concrete mixtures may be substituted as determined by engineer and local/state codes. Additionally, steel re-bar 60, 70 normally varies from ⅜" to ⅝" in diameter depending on the particular application and codes, but these measurements may be substituted as determined by structural engineers and state/local building codes requirements.

Additionally, typical applications use 6 mm thick fiber cement board in 4'×8' or 4'×10' sheets. At present the preferred fiber cement board that meets specification is one produced by the James Hardie Company, jameshardie.com, a world leader of cement board manufacturing, with U.S.A. offices at: 26300 La Alameda, Suite 400, Mission Viejo, Calif. 92691, and Europe offices located at: Second Floor, Europe House, Harcourt Centre, Harcourt Street, Dublin 2, Ireland.

It is noted that one advantage of the present invention is that upon pouring the concrete into the wall section 120, the wall section is acting as the concrete forms, to retain the shape of the wall. Also, the wall section 120 will remain with the dried concrete for the life of the building, unlike prior art forms that need to be removed from the concrete after it dries. Thus, saving time from having to remove the forms in the overall assembly process.

Another advantage of the presently illustrated embodiments is that the cement fiber boards 50, 55 may also have an insulation sheet attached thereto during the off-site assembly process. One skilled in the art knows that in some climates, it is advantageous to have added whole sheets of insulation on all the outer walls of a structure. In this fashion, it is now possible to attach, via glue or other known means, the insulation, often an inch or more of styrofoan or other know material, to the concrete fiber board 50, 55, then transport the fully assembled wall section 120 to the building construction site for erection and cement filling.

Additionally, although there is illustrated a box type spacer, one skilled in the art of structural design for building materials will realize that most any shape, besides the box, will be workable. For example, any form resembling a cone, frustoconical or tube would work, or any form of a box, like a rectangle, octagon, pentagon, triangle, etc. would also meet the design criteria.

Moreover, it is noted that a skilled artisan will realize that although concrete fiber board is illustrated for the two walls 50, 55, most any type of known wall material will also work. For example, plywood, sheet rock, or polymer, Styrofoam or any combinations of two or more layers of known materials may also be suitable for the intended uses for one or both walls 50, 55.

It is also contemplated that the illustrated holes 110 that are positioned on the wall spacer sides 20, 22 to include the glue spacers 130, 135, 140. In this arrangement, there would be positioned in a waffle-like arrangement of both holes 110 and glue spacers 130, 135, 140 all over the wall spacer sides 20, 22. Thus, taking advantage of each the two features to further secure the wall spacer 10 to the respective positions of the wall section 120 walls 50, 55.

Although the specification discusses placing the wall sections 120 over vertical rebars 70 that are affixed into the concrete foundations, one skilled in the art will realize that the same wall sections 120 will work by being placed on top of a second wall section 120 in a vertical position to form a stacked relationship, a two story type arrangement, or an overall building wall that includes a second layer of vertical wall sections 120 positioned above a first layer of vertical wall sections 120. In this arrangement, the extended vertical rebar 70 will extend into the second layer of wall sections 120. Thus, the rebar 70 is not directly coupled to the base foundation, but is coupled to the rebar 70 that extend from a lower wall section 120 as shown in FIG. 4.

Further, while the present invention has been fully described above with particularity and detail in connection with what is presently deemed to be the most practical and preferred embodiment of the invention, it will be apparent to those of ordinary skill in the art that numerous modifications, including, but not limited to, variation in size, materials, shape, form, function and manner of operation, assembly and use may be made, without departing from the principles and concepts of the invention as set forth in the claims.

What is claimed is:

1. A pre fabricated concrete wall form, comprising:

a. a first and second wall having a major surface facing each other;

b. at least one wall spacer positioned between and coupling together the first and second wall, wherein the wall spacer includes:

i. a top and bottom spacer wall, each having at least one hole formed in each;

ii. a first and second side spacer wall, coupled to the respective first and second wall;

iii. a first and second oppositely facing opening defined by the top, bottom, first and second side spacer walls; and iv. a central plate coupled within the top, bottom, first and second side spacer walls, wherein the central plate has a central plate hole;

c. at least one vertical and horizontal rebar, where the vertical rebar extends between the two walls and through the one hole formed in each of the top ban bottom spacer wall, and the horizontal rebar extending between the two walls and through the first and second oppositely facing opening and through the central plate hole;

d. a layer of concrete positioned between the first and second wall, and substantially filling the wall spacer through the first and second opening;

e. wherein, the first and second side spacer walls that are coupled to the respective first and second wall is coupled therebetween by glue;

f. wherein, the first and second side spacer walls have at least one glue spacer that perpendicularly extends from the first and second side spacer walls sufficiently to form a cavity between the first and second side spacer walls and the respective first and second walls; and g. wherein, the glue spacer has a shape that has a portion that imbeds a certain distance into the respective first and second wall.

2. The wall of claim 1, wherein the glue spacer is a rounded nub sufficiently designed to partially imbed a certain distance into the respective first and second wall.

3. The wall of claim 1, wherein the glue spacer has a point and imbeds the point a certain distance into the respective first and second wall.

4. A method of assembling a pre fabricated concrete wall, comprising:

a. providing a first and second wall having a major surface facing each other;

b. positioning at least one wall spacer between and coupling together the first and second wall, wherein the wall spacer includes:

i. a top and bottom spacer wall, each having at least one hole formed in each;

ii. a first and second side spacer wall, coupled to the respective first and second wall;

iii. a first and second oppositely facing opening defined by the top, bottom, first and second side spacer walls; and iv. a central plate coupled within the top, bottom, first and second side spacer walls, wherein the central plate has a central plate hole;

c. placing at least one vertical and horizontal rebar within the wall spacer, where the vertical rebar extends between the two walls and through the one hole formed in each of the top ban bottom spacer wall, and the horizontal rebar extending between the two walls and through the first and second oppositely facing opening and through the central plate hole;

d. pouring a layer of concrete between the first and second wall, and substantially filling the wall spacer through the first and second opening;

e. wherein, the first and second side spacer walls have at least one glue spacer that perpendicularly extends from the first and second side spacer walls sufficiently to form a cavity between the first and second side spacer walls and the respective first and second walls; and f. wherein, the glue spacer has a shape that allows for a portion to imbed a certain distance into the respective first and second wall.

5. The method of claim 4, wherein the glue spacer is a rounded nub that is shaped to allow for a portion to be imbedded a certain distance into the respective first and second wall.

6. The method of claim 4, wherein the glue spacer has a point and imbeds the point a certain distance into the respective first and second wall.

7. A method of assembling a pre fabricated concrete wall, comprising:

a. placing a first wall laid out in a horizontal position;

b. placing glue on the first wall in at least one location;

c. placing a wall spacers over the glue;

d. prepare a second wall by laying it horizontal, and applying glue to a respective matching location to that placed on the first wall;

e. placing the second wall on the opposite side of the wall spacers so that the glue abuts to the wall spacer to form a wall section;

f. drying the glue on the wall section;

g. transporting the wall section to a building work site;

h. providing a building with a foundation of concrete that was poured and formed with vertical rebar;

i. lifting up and sliding the wall section over the vertical rebars to fit through holes located in the wall spacers;

j. inserting horizontal rebars through second holes in the wall spacers;

k. using a connector tab to couple adjoining wall sections;

l. pouring cement between the first and second wall;

m. wherein the first and second side spacer walls have at least one glue spacer that perpendicularly extends from the first and second side spacer walls sufficiently to form a cavity between the first and second side spacer walls and the respective first and second walls; and n. wherein the glue spacer has a point and imbeds the point a certain distance into the respective first and second wall.

* * * * *